US012352452B2

(12) United States Patent
Johnson

(10) Patent No.: US 12,352,452 B2
(45) Date of Patent: Jul. 8, 2025

(54) OVEN APPLIANCE AND METHODS FOR ADAPTIVE COOKING

(71) Applicant: Haier US Appliance Solutions, Inc., Wilmington, DE (US)

(72) Inventor: Eric Scott Johnson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 645 days.

(21) Appl. No.: 17/682,347

(22) Filed: Feb. 28, 2022

(65) Prior Publication Data

US 2023/0272920 A1 Aug. 31, 2023

(51) Int. Cl.
*F24C 7/08* (2006.01)
*F24C 7/06* (2006.01)

(52) U.S. Cl.
CPC ..... *F24C 7/087* (2013.01); *F24C 7/067* (2013.01)

(58) Field of Classification Search
CPC ..... F24C 7/067; F24C 7/085; F24C 7/087
See application file for complete search history.

(56) References Cited

U.S. PATENT DOCUMENTS

| | | | |
|---|---|---|---|
| 3,358,122 | A | 12/1967 | Torrey |
| 4,865,010 | A | 9/1989 | Kett |
| 5,695,668 | A | 12/1997 | Boddy |
| 6,104,005 | A | 8/2000 | Adamski et al. |
| 6,337,468 | B1 | 1/2002 | Worthington et al. |
| 6,734,403 | B2 | 5/2004 | Baker et al. |
| 6,758,206 | B1 | 7/2004 | Barnes |
| 6,777,652 | B2 | 8/2004 | Stockley |
| 6,831,255 | B1 | 12/2004 | Levi et al. |
| 6,943,321 | B2 | 9/2005 | Brekken |
| 6,987,252 | B2 | 1/2006 | Goodrich |
| 7,378,617 | B1 | 5/2008 | Brockman |
| 8,049,142 | B2 | 11/2011 | Blackson |
| 8,269,151 | B2 | 9/2012 | Klasmeier et al. |
| 8,304,695 | B2 | 11/2012 | Bonuso et al. |
| 9,930,897 | B2 | 4/2018 | Blue et al. |
| 9,995,492 | B2 | 6/2018 | Adelmann |
| 10,012,392 | B2 | 7/2018 | Froelicher et al. |
| 10,082,297 | B2 | 9/2018 | Kim |
| 10,314,433 | B1 | 6/2019 | Knight |
| 10,448,457 | B2 | 10/2019 | Armstrong |
| 10,502,430 | B1 | 12/2019 | Alvey |

(Continued)

FOREIGN PATENT DOCUMENTS

| | | | |
|---|---|---|---|
| CN | 104767768 | A | 7/2015 |
| CN | 204795645 | U | 11/2015 |

(Continued)

*Primary Examiner* — Thien S Tran
(74) *Attorney, Agent, or Firm* — Dority & Manning, P.A.

(57) ABSTRACT

An oven appliance may provide for a method of adaptive cooking. The method may include receiving an oven temperature signal to indicate an oven temperature and directing activation of a bottom heating element according to a first heating cycle based on the oven temperature signal. The method may further include receiving a bottom temperature signal to indicate a bottom temperature and directing activation of the bottom heating element according to a second heating cycle based on the bottom temperature signal, the second heating cycle being distinct from the first heating cycle.

19 Claims, 9 Drawing Sheets

(56) References Cited

U.S. PATENT DOCUMENTS

| | | | | |
|---|---|---|---|---|
| 10,520,199 | B2 | 12/2019 | Polster | |
| 10,677,472 | B2 | 6/2020 | Johnson et al. | |
| 10,753,621 | B2 | 8/2020 | Johnson | |
| 10,895,385 | B2 | 1/2021 | Otsuki et al. | |
| 2004/0149722 | A1 | 8/2004 | Schnell et al. | |
| 2014/0130684 | A1 | 5/2014 | Reese et al. | |
| 2014/0360387 | A1 | 12/2014 | Bogdon | |
| 2015/0208669 | A1 | 7/2015 | Chamixaes | |
| 2016/0040892 | A1 | 2/2016 | Wiseman et al. | |
| 2016/0378082 | A1 | 12/2016 | Fisher et al. | |
| 2017/0089590 | A1 | 3/2017 | Bruin-Slot et al. | |
| 2017/0130968 | A1 | 5/2017 | Nagraj | |
| 2018/0003390 | A1 | 1/2018 | Trice et al. | |
| 2018/0020680 | A1 | 1/2018 | Froelicher et al. | |
| 2018/0159958 | A1 | 6/2018 | Lederer | |
| 2019/0327795 | A1 | 10/2019 | Hannah et al. | |
| 2020/0166217 | A1 | 5/2020 | Smith et al. | |
| 2021/0404745 | A1* | 12/2021 | Johnson | A21B 1/40 |

FOREIGN PATENT DOCUMENTS

| | | | |
|---|---|---|---|
| CN | 111145284 | A | 5/2020 |
| EP | 0579917 | A2 | 1/1994 |
| EP | 2251609 | B1 | 8/2017 |
| JP | H07280281 | A | 10/1995 |
| JP | 2010112664 | A | 5/2010 |
| JP | 2016217609 | A | 12/2016 |
| KR | 100821731 | B1 | 4/2008 |

* cited by examiner

OVEN APPLIANCE AND METHODS FOR ADAPTIVE COOKING

FIELD OF THE INVENTION

The present subject matter relates generally to oven appliances, and more particularly, to methods of operating an oven appliance for adaptive cooking.

BACKGROUND OF THE INVENTION

Conventional residential and commercial oven appliances generally include a cabinet that includes a cooking chamber for receipt of food items for cooking. Multiple gas or electric heating elements are positioned within the cabinet for heating the cooking chamber to cook food items located therein. The heating elements can include, for example, a bake heating assembly positioned at a bottom of the cooking chamber and a separate broiler heating assembly positioned at a top of the cooking chamber.

Typically, food or utensils for cooking are placed on wire racks within the cooking chamber and above the bake heating assembly. A temperature sensor within the cooking chamber may be used to maintain the cooking chamber at a select temperature. In some instances, protective or radiant plates are positioned over the bake heating assembly to protect the bake heating assembly or assist in evenly distributing heat across the bottom of the cooking chamber. Nonetheless, certain food items, such as pizzas or breads, may benefit from very high, localized (i.e., non-diffuse) heat, or a cooking utensil with a relatively high thermal mass may be used. This may be case when using a stone or specialized high-heat pan (e.g., to trap heat against the bottom of flat-breads or pizza) or a cast iron skillet.

Difficulties may arise in executing localized, high-heat operations, or with using cooking utensils that are heavy or otherwise have a high thermal mass. In particular, it may be difficult to consistently or appropriately heat the cooking chamber or cooking utensils therein. The wide variation for temperatures within an oven appliance (e.g., between the top and the bottom of the cooking chamber) may make it especially difficult to achieve consistent or desired temperatures, not simply within the cooking chamber generally, but also on the cooking surface supporting a food item thereon. For instance, occasions may arise in which the temperature detected at the temperature sensor is abnormally low in light of the heat output at the bottom heating element. Such occasions may be caused by user actions, such as placing a baking stone over a bottom heating element or an especially large or cold food item drawing excessive heat away from the cooking surface. In conventional appliances, this may lead to inadequate or unsatisfactory cooking of the food item. On other occasions, the temperature detected at the temperature sensor may be abnormally high in light of the heat output at the bottom heating element, such as may occur when aluminum foil is placed on the bottom of the oven. In conventional appliances, this may cause damage to the appliance or risk burning the food.

Accordingly, it would be advantageous to provide an oven appliance or methods for consistently or accurately heating an oven appliance (e.g., while adapting to various food items or conditions within the cooking chamber). Additionally or alternatively, it may be advantageous to provide an oven appliance or method for detecting and addressing abnormal conditions within the cooking chamber.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an oven appliance is provided. The oven appliance may include a cabinet, a plurality of chamber walls, a cooking surface, a top heating element, an oven temperature sensor, a bottom heating element, a bottom temperature sensor, and a controller. The plurality of chamber walls may be mounted within the cabinet, the plurality of chamber walls defining a cooking chamber. The plurality of chamber walls may include a back wall, a top wall, a first side wall, a second side wall, and a bottom wall. The cooking surface may be defined in the cooking chamber between the bottom wall and the top wall of the plurality of chamber walls. The top heating element may be mounted above the cooking surface to heat the cooking chamber. The oven temperature sensor may be disposed within the cabinet. The bottom heating element may be mounted below the cooking surface to heat the cooking surface. The bottom temperature sensor may be disposed below the oven temperature sensor. The controller may be in operative communication with the top heating element, the oven temperature sensor, the bottom heating element, and the bottom temperature sensor. The controller may be configured to initiate a cooking operation including receiving an oven temperature signal from the oven temperature sensor to indicate an oven temperature, directing activation of the bottom heating element according to a first heating cycle based on the oven temperature signal, receiving a bottom temperature signal from the bottom temperature sensor to indicate a bottom temperature, and directing activation of the bottom heating element according to a second heating cycle based on the bottom temperature signal, the second heating cycle being distinct from the first heating cycle.

In another exemplary aspect of the present disclosure, a method of operating an oven appliance is provided. The method may include receiving an oven temperature signal to indicate an oven temperature and directing activation of a bottom heating element according to a first heating cycle based on the oven temperature signal. The method may further include receiving a bottom temperature signal to indicate a bottom temperature and directing activation of the bottom heating element according to a second heating cycle based on the bottom temperature signal, the second heating cycle being distinct from the first heating cycle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
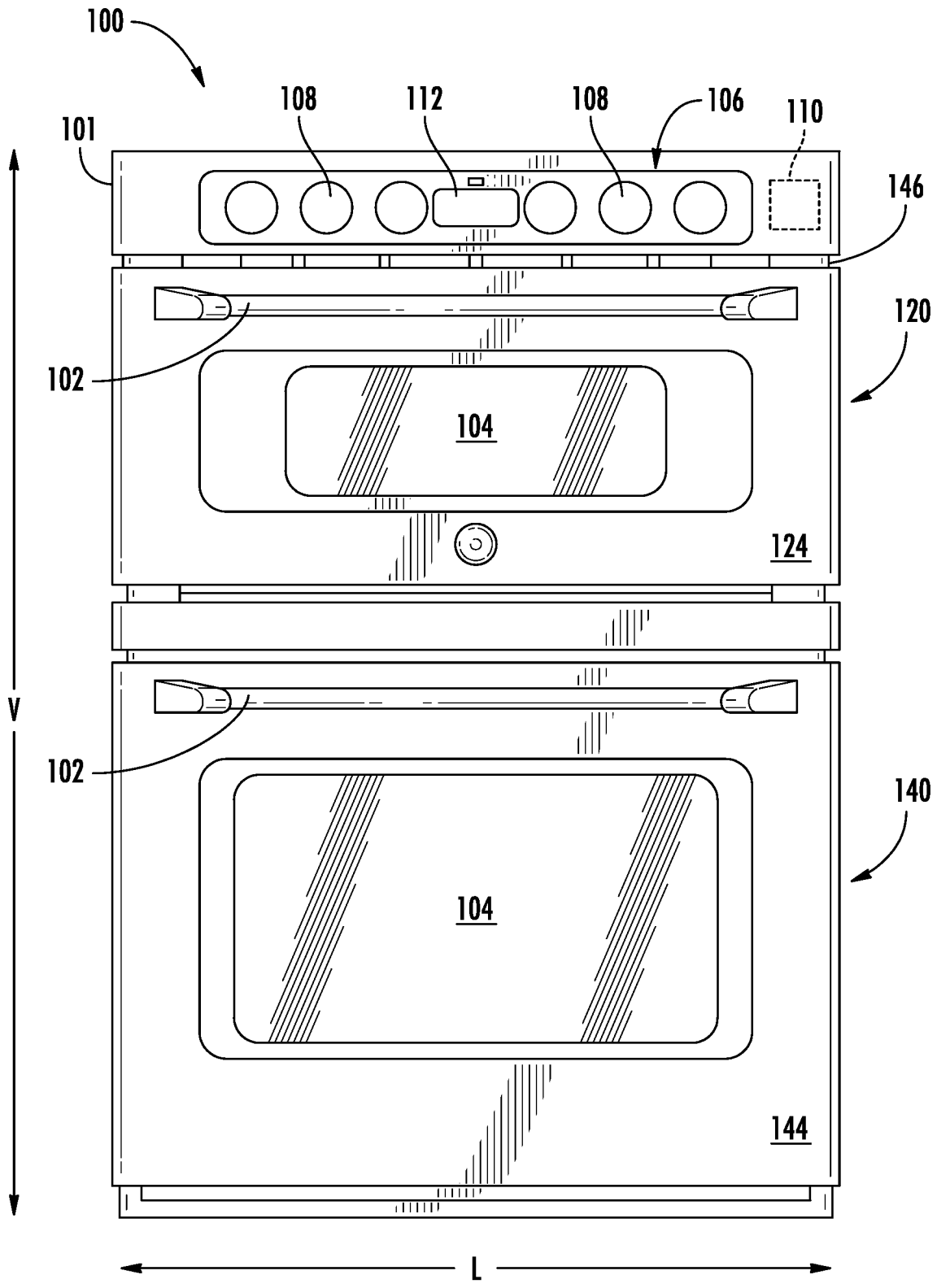
FIG. 1 provides an elevation view of an oven appliance according to exemplary embodiments of the present disclosure.
Figure 2:
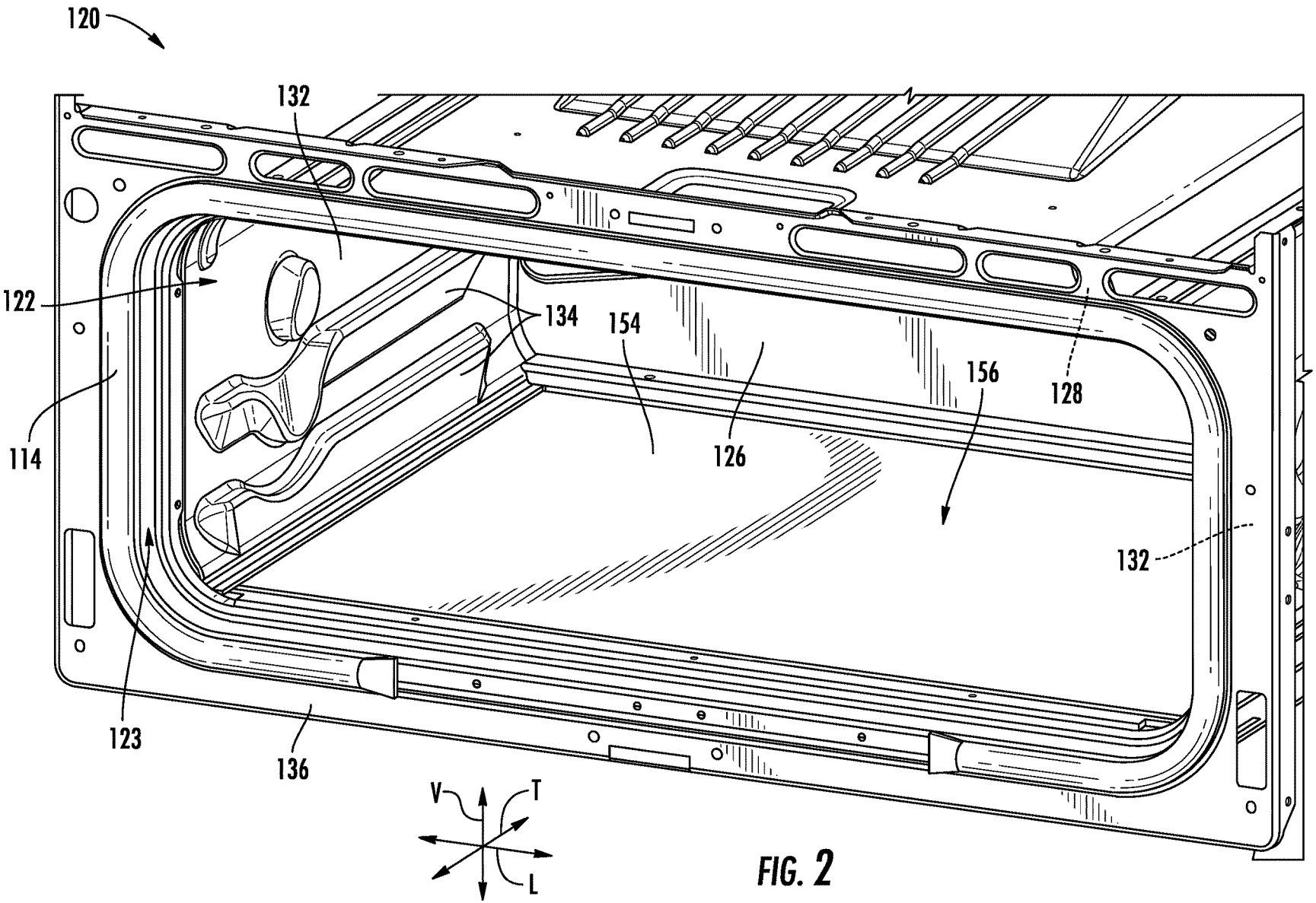
FIG. 2 provides a perspective view of an upper cooking chamber of the exemplary oven appliance of FIG. 1.
Figure 3:
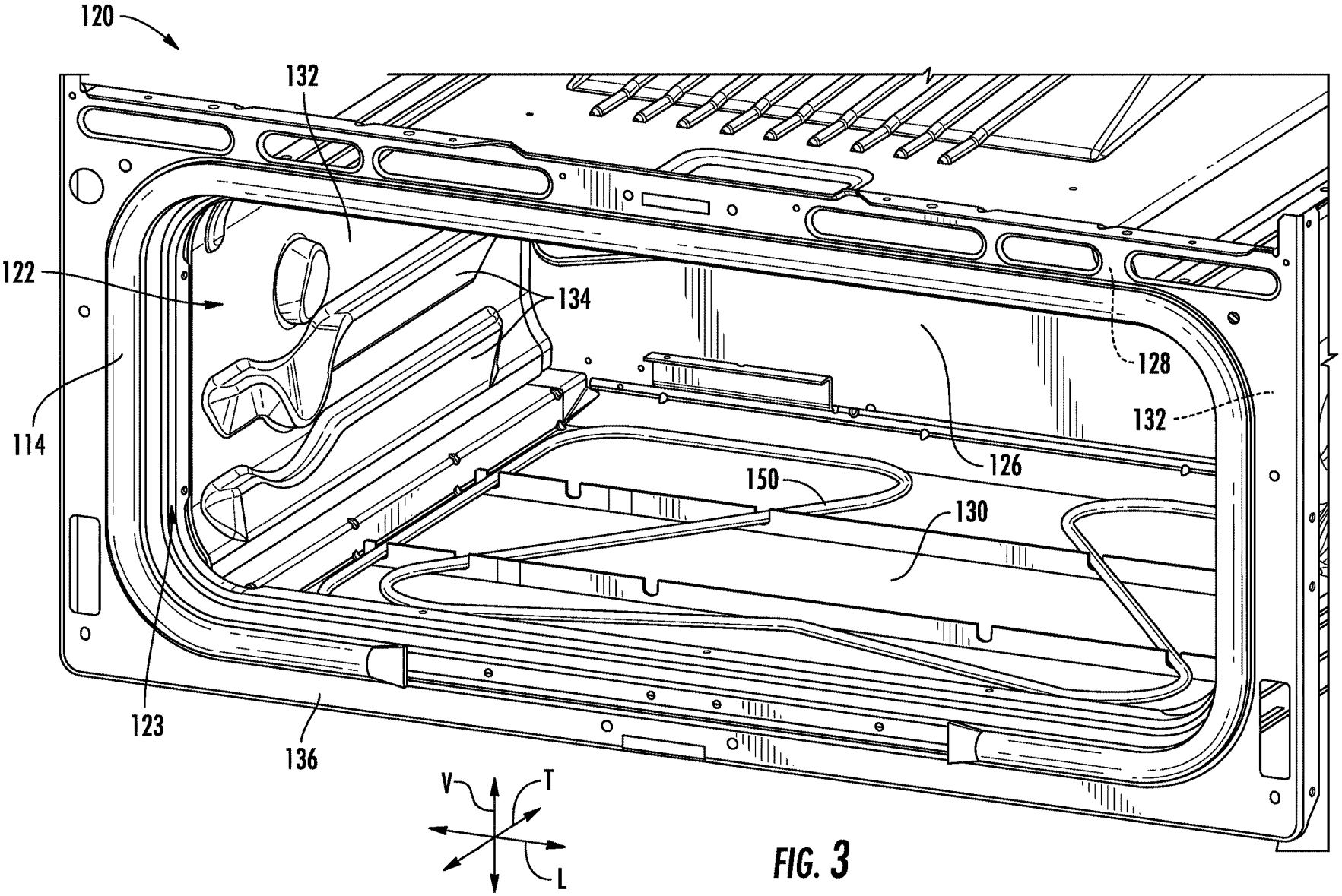
FIG. 3 provides another perspective view of the upper cooking chamber of the exemplary oven appliance of FIG. 1, wherein a cooking plate has been omitted for clarity.
Figure 4:
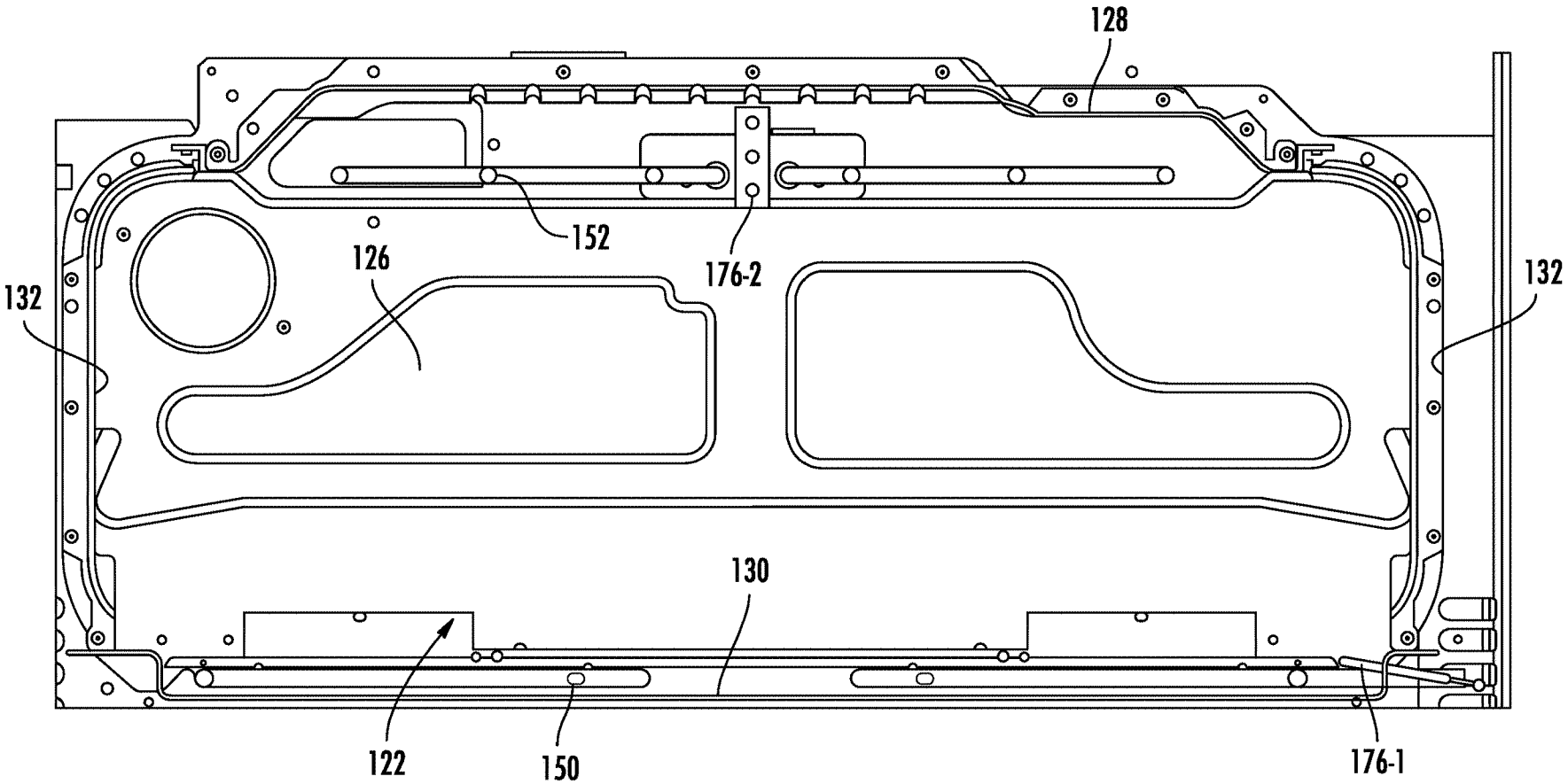
FIG. 4 provides an elevation view of the exemplary upper cooking chamber of FIG. 3.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "coupled," "fixed," "attached to," and the like refer to both direct coupling, fixing, or attaching, as well as indirect coupling, fixing, or attaching through one or more intermediate components or features, unless otherwise specified herein.

Referring now to the drawings, FIG. 1 illustrates an exemplary embodiment of a double oven appliance 100 according to the present disclosure.

Although aspects of the present subject matter are described herein in the context of a double oven appliance 100, it should be appreciated that oven appliance 100 is provided by way of example only. Other oven or range appliances having different configurations, different appearances, or different features may also be utilized with the present subject matter as well (e.g., single ovens, electric cooktop ovens, induction cooktops ovens, etc.).

Generally, oven appliance 100 has a cabinet 101 that defines a vertical direction V, a longitudinal direction L and a transverse direction T. The vertical, longitudinal and transverse directions are mutually perpendicular and form an orthogonal direction system. In this regard, as used herein, the terms "cabinet," "housing," and the like are generally intended to refer to an outer frame or support structure for appliance 100, e.g., including any suitable number, type, and configuration of support structures formed from any suitable materials, such as a system of elongated support members, a plurality of interconnected panels, or some combination thereof. It should be appreciated that cabinet 101 does not necessarily require an enclosure and may simply include open structure supporting various elements of appliance 100. By contrast, cabinet 101 may enclose some or all portions of an interior of cabinet 101. It should be appreciated that cabinet 101 may have any suitable size, shape, and configuration while remaining within the scope of the present subject matter.

Double oven appliance 100 includes an upper oven 120 and a lower oven 140 positioned below upper oven 120 along the vertical direction V. Upper and lower ovens 120 and 140 include oven or cooking chambers 122 and 142, respectively, configured for the receipt of one or more food items to be cooked. Specifically, cabinet 101 defines a respective opening for each cooking chamber 122 and 142. For instance, an upper opening 123 may be defined (e.g., along the transverse direction T) to access upper cooking chamber 122.

Double oven appliance 100 includes an upper door 124 and a lower door 144 in order to permit selective access to cooking chambers 122 and 142, respectively (e.g., via the corresponding opening). Handles 102 are mounted to upper and lower doors 124 and 144 to assist a user with opening and closing doors 124 and 144 in order to access cooking chambers 122 and 142. As an example, a user can pull on handle 102 mounted to upper door 124 to open or close upper door 124 and access cooking chamber 122. Glass window panes 104 provide for viewing the contents of cooking chambers 122 and 142 when doors 124, 144 are closed and also assist with insulating cooking chambers 122 and 142. Optionally, a seal or gasket (e.g., gasket 114) extends between each door 124, 144 and cabinet 101 (e.g., when the corresponding door 124 or 144 is in the closed position). Such gasket may assist with maintaining heat and cooking fumes within the corresponding cooking chamber 122 or 142 when the door 124 or 144 is in the closed position. Moreover, heating elements, such as electric resistance heating elements, gas burners, microwave elements, etc., are positioned within upper and lower oven 120 and 140.

A control panel 106 of double oven appliance 100 provides selections for user manipulation of the operation of double oven appliance 100. For example, a user can touch control panel 106 to trigger one of user inputs 108. In response to user manipulation of user inputs 108, various components of the double oven appliance 100 can be operated. Control panel 106 may also include a display 112, such as a digital display, operable to display various parameters (e.g., temperature, time, cooking cycle, etc.) of the double oven appliance 100.

Figure 5:
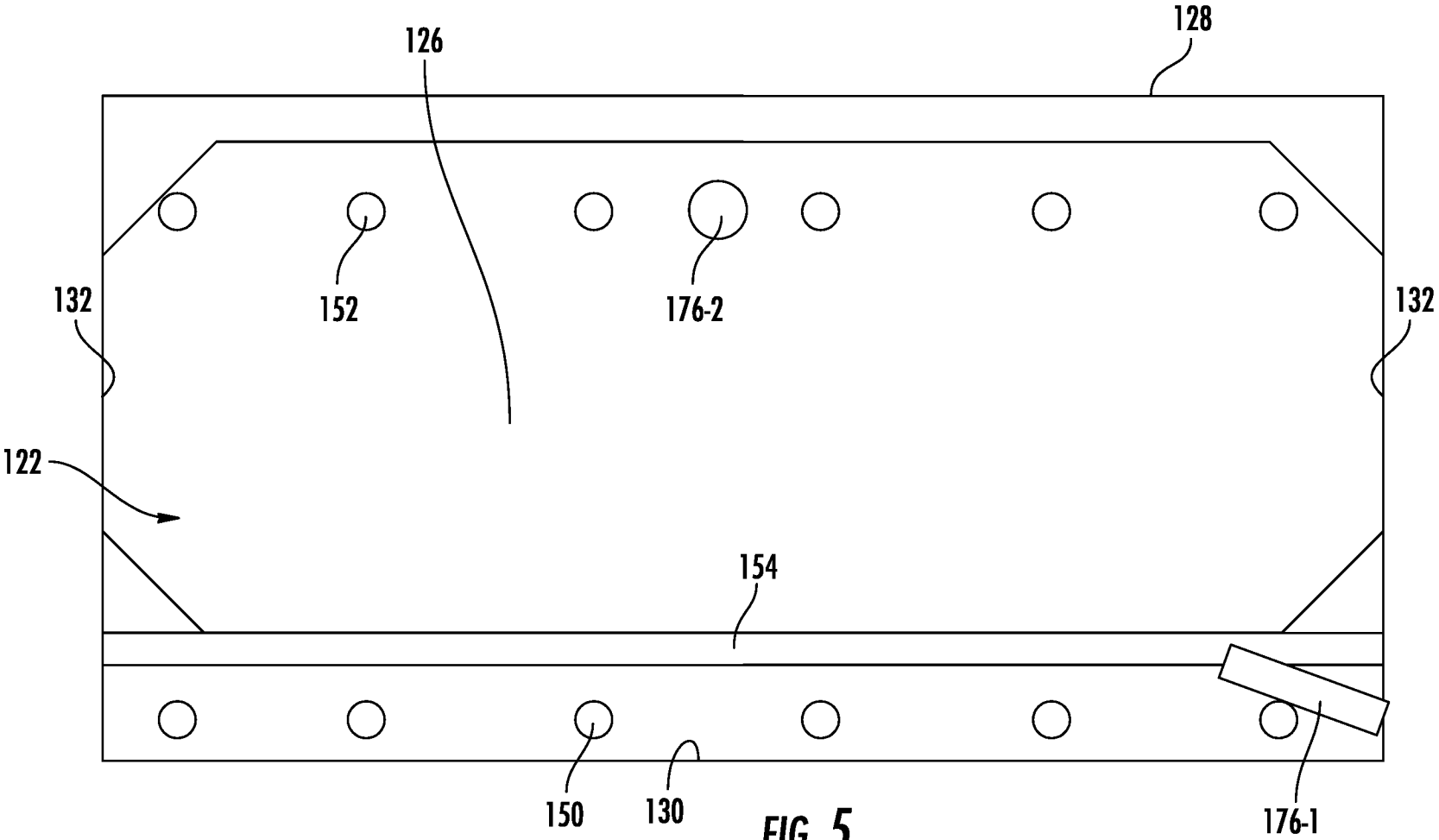
FIG. 5 provides a schematic elevation view of the upper cooking chamber of the exemplary oven appliance of FIG. 1.

Generally, oven appliance 100 may include a controller 110 in operative communication (e.g., operably coupled via a wired or wireless channel) with control panel 106. Control panel 106 of oven appliance 100 may be in communication with controller 110 via, for example, one or more signal lines or shared communication busses, and signals generated in controller 110 operate oven appliance 100 in response to user input via user input devices 108. Input/Output ("I/O") signals may be routed between controller 110 and various operational components of oven appliance 100 such that operation of oven appliance 100 can be regulated by controller 110. In addition, controller 110 may also be in communication with one or more sensors, such as a first temperature sensor (TS1) 176-1 or a second temperature sensor (TS2) 176-2 (FIG. 5). Generally, either or both TS1 176-1 and TS2 176-2 may include or be provided as a thermistor or thermocouple, which may be used to measure temperature at a location proximate to upper cooking chamber 122 and provide such measurements to the controller 110. Although TS1 176-1 is illustrated as a probe extending proximate to or above bottom heating element 150 (e.g., to or below a cooking plate 154) and TS2 176-2 is illustrated proximate to or below top heating element 152 (e.g., above ribs 134 or cooking plate 154), it should be appreciated that other sensor types, positions, and configurations may be used according to alternative embodiments.

Controller 110 is a "processing device" or "controller" and may be embodied as described herein. Controller 110 may include a memory and one or more microprocessors, microcontrollers, application-specific integrated circuits (ASICS), CPUs or the like, such as general or special purpose microprocessors operable to execute programming instructions or micro-control code associated with operation of oven appliance 100, and controller 110 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, controller 110 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Turning now to FIGS. 2 through 5, various views are provided illustrating, in particular, upper cooking chamber 122 of upper oven 120. As shown, upper cooking chamber 122 is generally defined by a back wall 126, a top wall 128 and a bottom wall 130 spaced from top wall 128 along the vertical direction V by opposing side walls 132 (e.g., a first wall and a second wall). Optionally, a front plate 136 may be attached to the walls to define the upper opening 123. For instance, front plate 136 may extend along bottom wall 130, top wall 128, and the opposing side walls 132 about upper opening 123. In turn, gasket 114 may be mounted on or engaged with front plate 136 (e.g., when the corresponding upper door is closed). In some embodiments opposing side walls 132 include embossed ribs 134 such that a baking rack containing food items may be slidably received onto embossed ribs 134 and may be moved into and out of upper cooking chamber 122 when door 124 is open. Optionally, such walls 126, 128, 130, 132 may be included within an outer casing 146 of cabinet 101, as is understood.

As shown, upper oven includes one or more heating elements to heat upper cooking chamber 122 (e.g., as directed by controller 110 as part of a cooking operation). For instance, a bottom heating element 150 may be mounted at a bottom portion of upper cooking chamber 122 (e.g., above bottom wall 130). Additionally or alternatively, a top heating element 152 may be mounted at a top portion of upper cooking chamber 122 (e.g., below top wall 128). Bottom heating element 150 and top heating element 152 may be used independently or simultaneously to heat upper cooking chamber 122, perform a baking or broil operation, perform a cleaning cycle, etc.

The heating elements 150, 152 may be provided as any suitable heater for generating heat within upper cooking chamber 122. For instance, either heating element may include an electric heating element (e.g., resistance wire elements, radiant heating element, electric tubular heater or CALROD®, halogen heating element, etc.). Additionally or alternatively, either heating element may include a gas burner.

In some embodiments, a cooking plate 154 is provided within upper cooking chamber 122. Specifically, cooking plate 154 is disposed above bottom heating element 150 and may generally cover the same. Along with being disposed above bottom heating element 150, cooking plate 154 is disposed below top heating element 152 and may be disposed below (e.g., at a lower vertical height than) each of the embossed ribs. In certain embodiments, cooking plate 154 is located at or near the same vertical height as the bottommost edge of upper opening 123. Thus, cooking plate 154 may generally be disposed proximal to the lower end of the cooking chamber 122.

When mounted within cooking chamber 122, cooking plate 154 may extend along the transverse direction T between a front end and a rear end, along the lateral direction L between a first lateral end and a second lateral end, and along the vertical direction V between an upper cooking surface 156 and a lower surface. The cooking surface 156, in particular, may be disposed between the bottom wall 130 and the top wall 128. Moreover, cooking surface 156 may be proximal to the bottom wall 130 and, thus, distal to the top wall 128. In some embodiments, cooking plate 154 is provided as a solid nonpermeable member. Thus, food or fluids may be prevented from passing through cooking plate 154 (e.g., along the vertical direction V or perpendicular to cooking surface 156). In certain embodiments, cooking plate 154 includes or is formed from a conductive metal material, such as cast iron, steel, or aluminum (e.g., including alloys thereof). In additional or alternative embodiments, cooking plate 154 includes or is formed from a heat-retaining material, such as clay, stone (e.g., cordierite), ceramic, cast iron, or ceramic-coated carbon steel.

As shown, the cooking plate 154 may be disposed directly above (e.g., in vertical alignment with) the bottom heating element 150. Moreover, cooking plate 154 may define a horizontal footprint that spans across horizontal footprint of bottom heating element 150. In turn, cooking plate 154 may fully cover bottom heating element 150. When mounted within cooking chamber 122, cooking plate 154 may block or otherwise prevent access to bottom heating element 150, such as by a user reaching into the cooking chamber 122. Additionally or alternatively, the bottom heating element 150 may be held out of view such that a user is unable to see the bottom heating element 150. During use, heat generated at bottom heating element 150 may be directed upward to a lower surface of cooking plate 154. As noted, bottom heating element 150 may be vertically aligned with (e.g., directly beneath) the cooking plate 154. The heat generated at bottom heating element 150 may thus be guided primarily or initially to the underside of cooking plate 154.

One or more temperature sensors (e.g., TS1 176-1) may be provided proximal to the bottom wall 130 (i.e., distal to top wall 128) in or otherwise within thermal communication with cooking chamber 122, for instance, to detect the temperature of bottom heating element 150 or cooking plate 154. Optionally, TS1 176-1 may be mounted or held between the bottom heating element 150 and the cooking plate 154. In some embodiments, a TS1 176-1 is disposed against (e.g., a bottom surface of) cooking plate 154. As an example, TS1 176-1 may be disposed on a bottom surface of cooking plate 154 (e.g., when cooking plate 154 is mounted within cooking chamber 122). As an additional or alternative example, TS1 176-1 may be held within a recess in cooking plate 154. As an additional or alternative example, TS1 176-1 may be embedded within cooking plate 154.

Additionally or alternatively, one or more temperature sensors (e.g., TS2 176-2) may be provided proximal to the top wall 128 (i.e., distal to bottom wall 130) in or otherwise within thermal communication with cooking chamber 122, for instance, to detect the temperature of top heating element 152 or cooking chamber 122, generally. Optionally, TS2 176-2 may be mounted between the top wall 128 and the cooking plate 154 (e.g., above TS1 176-1). In some embodiments, TS2 176-2 is mounted at or below heating element 152. Specifically, TS2 176-2 may be laterally positioned between the side walls 132 (e.g., at substantially the lateral middle of cooking chamber 122). As an example, TS2 176-2 may be connected to or otherwise supported on back wall 126 (e.g., via a mechanical fastener, clip, or hook).

When assembled, the temperature sensor(s) 176-1, 176-2 may be operably coupled to controller 110. Moreover, the controller 110 may be configured to control top heating element 152 or bottom heating element 150 based on one or more temperatures detected at the temperature sensor(s) 176-1, 176-2 (e.g., as part of a cooking operation). In some embodiments, a cooking operation initiated by the controller 110 may thus include detecting one or more temperatures of TS1 176-1 and TS2 176-2, and directing heat output from (e.g., a heat setting of) top heating element 152 or bottom heating element 150 based on the detected temperature(s).

Figure 6:
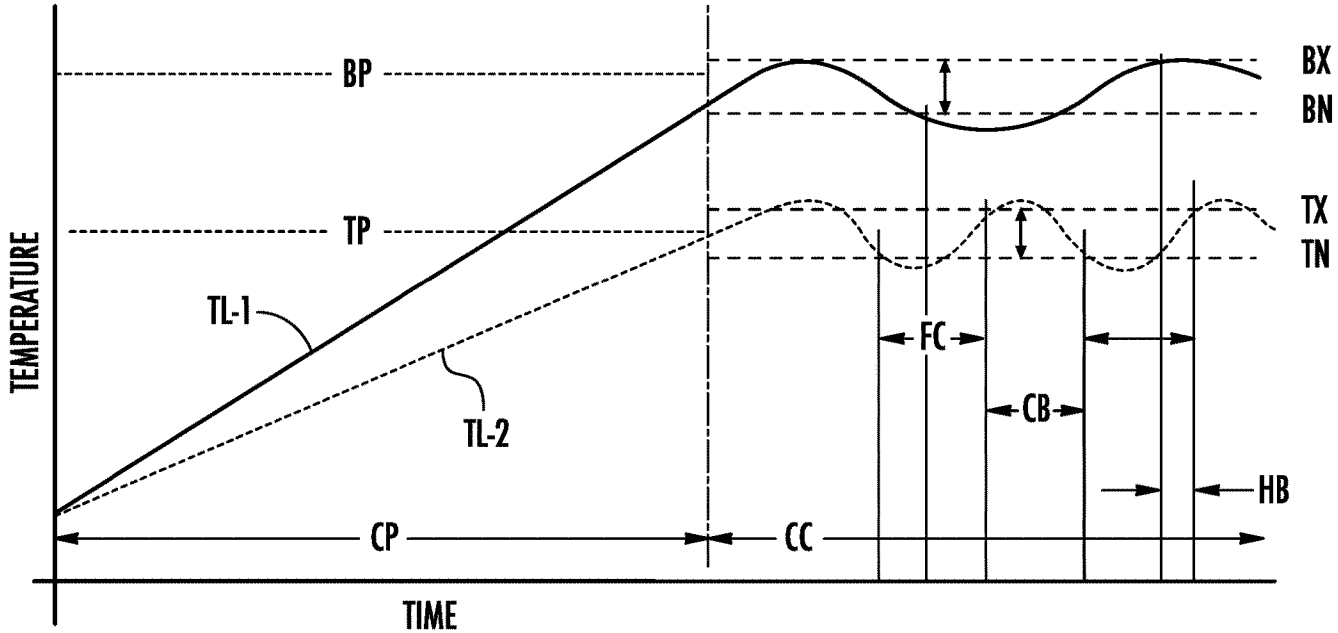
FIG. 6 is a graph view illustrating a temperature over time for two discrete temperature sensors within an oven appliance during a cooking operation according to exemplary embodiments of the present disclosure.
Figure 7:
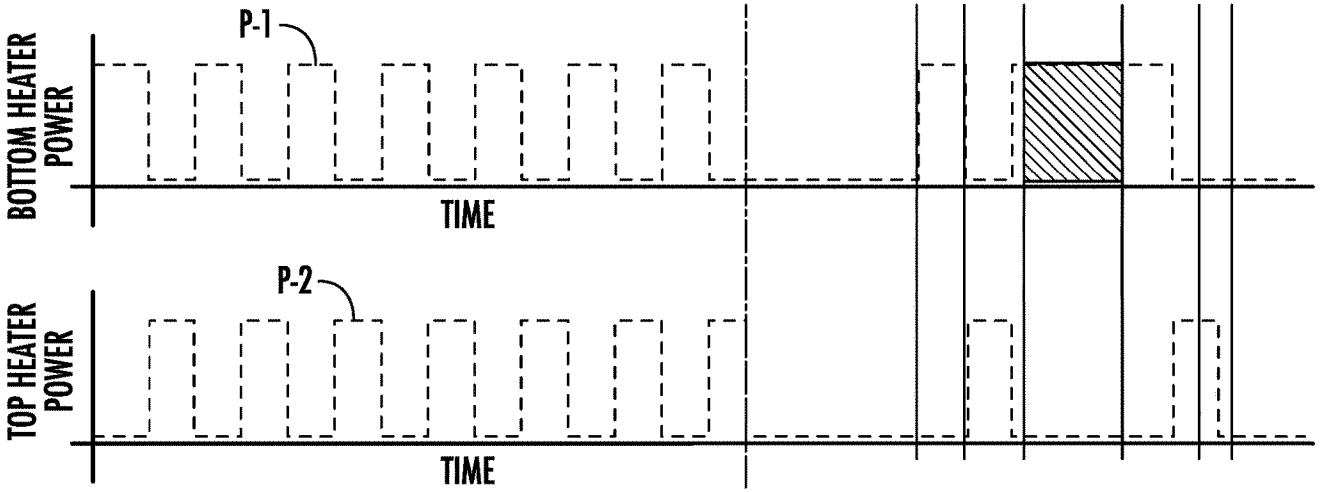
FIG. 7 is a graph view illustrating power output over time for two discrete heaters within an oven appliance during the exemplary cooking operation of FIG. 6.

As an example, and turning briefly to FIGS. 6 and 7, graphs are provided to illustrate a cooking operation directed by controller 110 (FIG. 1) in operative communication with the heating elements 150, 152 (FIG. 5) and temperature sensors 176-1, 176-2 (FIG. 5). In particular, FIG. 6 provides a graph of temperature lines TL-1, TL-2 detected at TS1 176-1 and TS2 176-2, respectively. FIG. 7 provides a graph of output line P-1, P-2 for power output (e.g., as dictated by a duty cycle) at bottom heating element 150 and top heating element 152, respectively. Although the illustrated power output lines P-1, P-2 illustrate the binary active-inactive states of a duty cycle, substitution may be made of a duty cycle for a TRIAC-regulated power cycle wherein power output is directed as a percentage of maximum power output, as would be understood.

As shown, the cooking operation may include a preheat phase CP in which the top heater output P-2 and the bottom heater output P-1 is directed according to a heating (e.g., preheating) cycle. In the preheating cycle, one duty cycle or heat output (e.g., top heat output setting) may be set for the top heating element and another duty cycle or heat output (e.g., bottom heat output) may be set for the bottom heating element. Thus, top heater output P-2 during the preheat phase CP may correspond to the top heat output setting for the preheating cycle while the bottom heater output P-1 during the preheat phase CP may correspond to the bottom heat output setting for the preheating cycle.

As an exemplary top heat output setting for the top heater output P-2, the top heating element 152 may be cycled according to a duty cycle of the first preheating cycle. Thus, the top heating element 152 may be activated and deactivated in a predetermined or set sequence (e.g., 15 seconds on and 45 seconds off) that repeats (e.g., for the duration of the preheat phase CP or a portion thereof) to output heat at the top heat output setting. As an exemplary bottom heat output setting for the bottom heater output P-1, the bottom heating element 150 may be cycled according to a duty cycle of the second preheating cycle. Thus, the bottom heating element 150 may be activated and deactivated in a predetermined or set sequence (e.g., 45 seconds on and 15 seconds off) that repeats (e.g., for the duration of the preheat phase CP of a portion thereof) to output heat at the bottom heat output setting. Optionally, activation of the top heating element 152 and the bottom heating element 150 may be alternated (e.g., such that "time on" or "active time" for the top heating element 152 during the preheating cycle coincides with the "time off" or "inactive time" for the bottom heating element 150, and vice versa).

Generally, during the preheat phase CP, temperature (e.g., as measured along TL-1 and TL-2) increases within the cooking chamber 122, as shown. In some embodiments, the preheat phase CP is permitted to continue until an oven preheat max TP (e.g., maximum threshold) of the cooking chamber 122 (e.g., at TL-2) is met or exceeded. The oven preheat max TP being met or exceeded may, in turn, halt the preheat phase CP.

Figure 8:
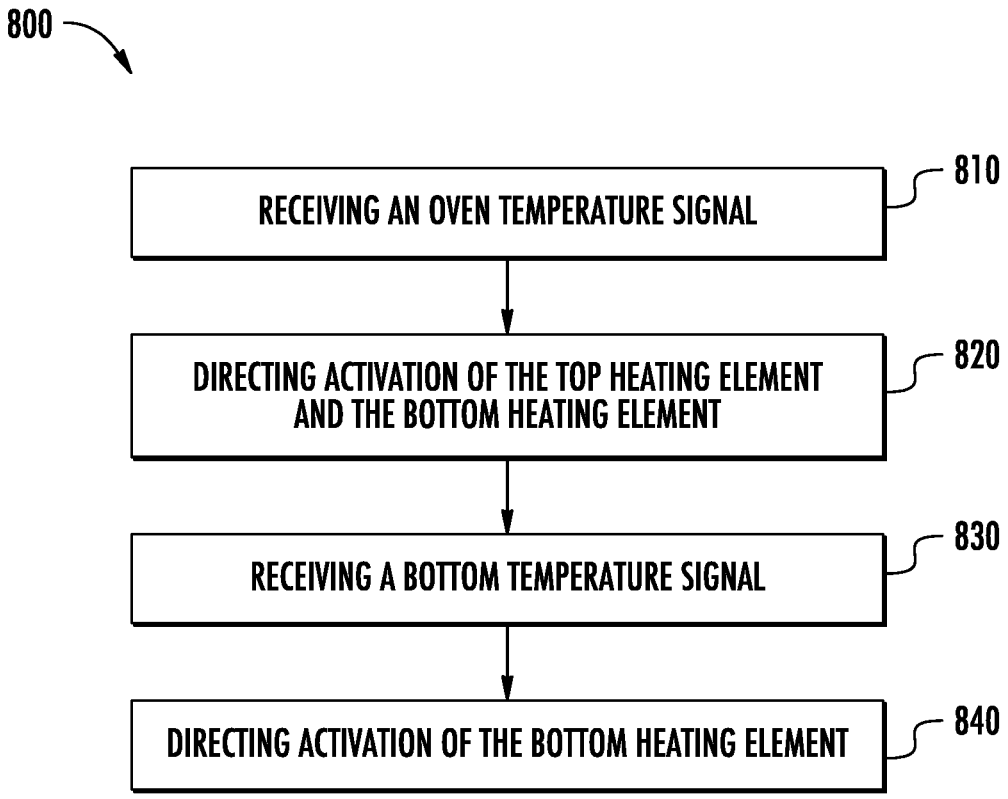
FIG. 8 is a flow chart illustrating of method of operating an oven appliance according to exemplary embodiments of the present disclosure.

Although not occurring in the exemplary graphs of FIGS. 7 and 8, it is noted that a bottom preheat max BP (e.g., maximum threshold) of the bottom heating element 150 (e.g., at TL-1) may be met or exceeded prior to the oven preheat max TP of the cooking chamber 122 (e.g., at TL-2). Reaching the bottom preheat max BP during the preheat phase CP may prompt a new bottom heat output setting (e.g., duty cycle) to be initiated at the bottom heating element 150. In other words, the previous (e.g., first) bottom heat output setting for bottom heater output P-1 may be stopped while the new (e.g., second) bottom heat output setting for bottom heater output P-1 is executed. Optionally, the top heat output setting may be maintained even as the bottom heat output setting changes. In some embodiments, the new or second bottom heat output setting is less than the previous or first bottom heat output setting. For instance, a duty cycle of the second bottom heat output setting may provide less (or no) time on or active time relative to the off time or inactive time than the first bottom heat output setting. The new or second bottom heat output setting may continue (e.g., repeating the corresponding duty cycle) until, for instance, the oven preheat max TP of the cooking chamber 122 is met or exceeded or the temperature at TL-1 falls below, for instance, a set range from the bottom preheat max BP. In some such embodiments, falling back below the set range from the bottom preheat max BP (or range therefrom) may prompt reinstatement of the first bottom heat output setting.

Advantageously, the cooking plate 166 or surface 168 within the cooking chamber 122 may be preheated to a desired temperature (e.g., without being excessively heated) while the cooking chamber 122 also reaches a desired preheat temperature.

Following the preheat phase CP (e.g., immediately thereafter), a cooking phase CC may be initiated. In instances where heat continues to rise following the start of the cooking phase CC, the cooking phase CC may restrict the top heater output P-2 or the bottom heater output P-1 (e.g., to reduce heat output from the preheat phase CP). For instance, the top heating element 152 and bottom heating element 150 may be held in inactive states, reducing top heater output P-2 and bottom heater output P-1 to zero.

In response to the oven temperature at TL-2 falling below an oven min TN (e.g., a minimum threshold or threshold value defined by a set range below a maximum threshold), the top heating element 152 or the bottom heating element 150 may be activated according to a first heating (e.g., default or cooking) cycle FC. In the cooking cycle FC, one duty cycle or heat output (e.g., top heat output setting) may be set for the top heating element 152 and another duty cycle or heat output (e.g., bottom heat output setting) may be set for the bottom heating element 150. Thus, top heater output P-2 during at least a portion of the cooking phase CC may correspond to the top heat output setting for the cooking cycle FC while the bottom heater output P-1 during at least a portion of the cooking phase CC may correspond to the bottom heat output setting for the cooking cycle FC. Generally, the cooking cycle FC may continue until, for instance, an oven cook max TX (e.g., maximum threshold) is met or exceeded at TL-2 or a bottom cook max BX (e.g., maximum threshold) is met or exceeded at TL-1. For instance, if the oven cook max TX is met or exceeded at TL-2, top heater output P-2 and bottom heater output P-1 may be reduced or directed to zero (e.g., until temperature at TL-2 falls below the oven min TN).

It is noted that although a thermostatic range is illustrated in FIG. 6 (e.g., between BX and BN or between TX and TN), one of ordinary skill, in light of the present disclosure, will understand that a Proportional-Integral-Derivative (PID) control scheme may be employed to control the output of the bottom heating element 150 or the top heating element 152 based on how far the bottom and oven temperatures, respectively, are from a predetermined set point or threshold.

As shown, in some instance, variations in temperatures TL-1 and TL-2 may lead to a "cold bake" condition within the cooking chamber 122. As an example, temperature at TL-1 may fall below a bottom cook min BN (e.g., minimum threshold) while the temperature at TL-2 remains above the oven min TN (e.g., after meeting or exceeding the oven cook max TX and before the top heating element 152 is reactivated). In such a condition, the top heater output P-2 may be held at zero (e.g., because the oven cook max TX had been reached but TL-2 has not yet fallen below the oven min TN). Nonetheless, the bottom heating element 150 may be activated according to a cold-bake cycle CB. For instance, the bottom heater output P-1 may be activated at a temperature-responsive condition based on temperature TL-1 or TL-2. The temperature-responsive condition may be, as an example, the bottom cook max BX being met or exceeded or falling below the oven min TN. In the illustrated embodiment, the bottom heater output P-1 is held at an active level until the temperature-responsive condition is met (e.g., TL-1 meets or exceeds the bottom cook max BX or TL-2 falls below the oven min TN). Upon meeting the temperature-responsive condition, the bottom heating element 150 may be directed to an inactive state or another cooking cycle. Additionally or alternatively, the bottom heating element 150 may be directed to an inactive state or another cooking cycle in response to the temperature at TL-2 falling below the oven min TN, or the cooking operation being otherwise halted (e.g., by a user input).

Advantageously, the cooking plate 166 or surface 168 within the cooking chamber 122 may be maintained at a desired temperature or range (e.g., without being excessively cooled) while the cooking chamber 122 also holds a desired cooking temperature range.

As further shown, in some instances, other variations in temperatures TL-1 and TL-2 may lead to a "hot-bake" condition within the cooking chamber 122. As an example, temperature at TL-1 may meet or exceed a bottom cook max BX while the temperature at TL-2 remains below the oven cook max TX. In such a condition, the top heater output P-2 may be held active or otherwise directed according to a cooking cycle (e.g., because TL-2 had fallen below the oven min TN but has not yet met or exceeded the oven cook max TX). In response to the hot-bake condition being reached, the bottom heating element 150 may be directed according to a hot-bake cycle HB. In the hot-bake cycle HB a new bottom heat output setting (e.g., duty cycle) may be initiated at the bottom heating element 150. In other words, the previous bottom heat output setting (e.g., of the cooking or cold-bake cycle CB) for bottom heater output P-1 may be stopped while the new (e.g., second) bottom heat output setting for bottom heater output P-1 is executed. Optionally, the top heat output setting may be maintained (e.g., equal to that of the cooking cycle FC) even as the bottom heat output setting changes. In some embodiments, the new or second bottom heat output setting is less than the previous or first bottom heat output setting (e.g., bottom heat output setting of the cooking cycle). For instance, a duty cycle of the second bottom heat output setting may provide less (or no) time on or active time relative to the off time or inactive time than the first bottom heat output setting. The new or second bottom heat output setting may continue (e.g., repeating the corresponding duty cycle) until, for instance, TL-1 falls below the bottom cook min BN or the temperature at TL-2 exceeds the oven cook max TX.

Advantageously, the cooking plate 166 or surface 168 within the cooking chamber 122 may be maintained at a desired temperature or range (e.g., without being excessively heated) while the cooking chamber 122 also holds a desired cooking temperature range.

Figure 9:
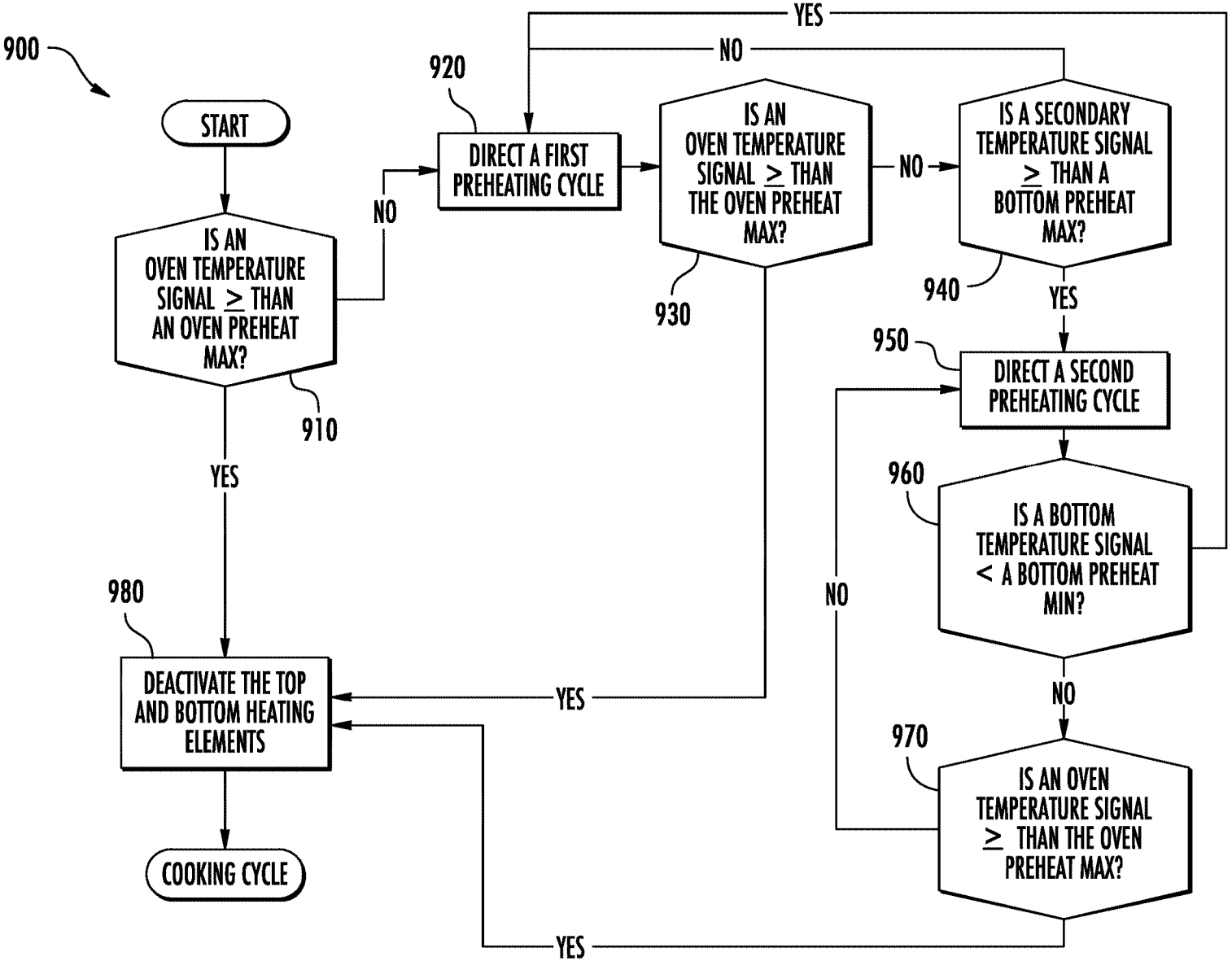
FIG. 9 is a flow chart illustrating of method of operating an oven appliance according to exemplary embodiments of the present disclosure.
Figure 10:
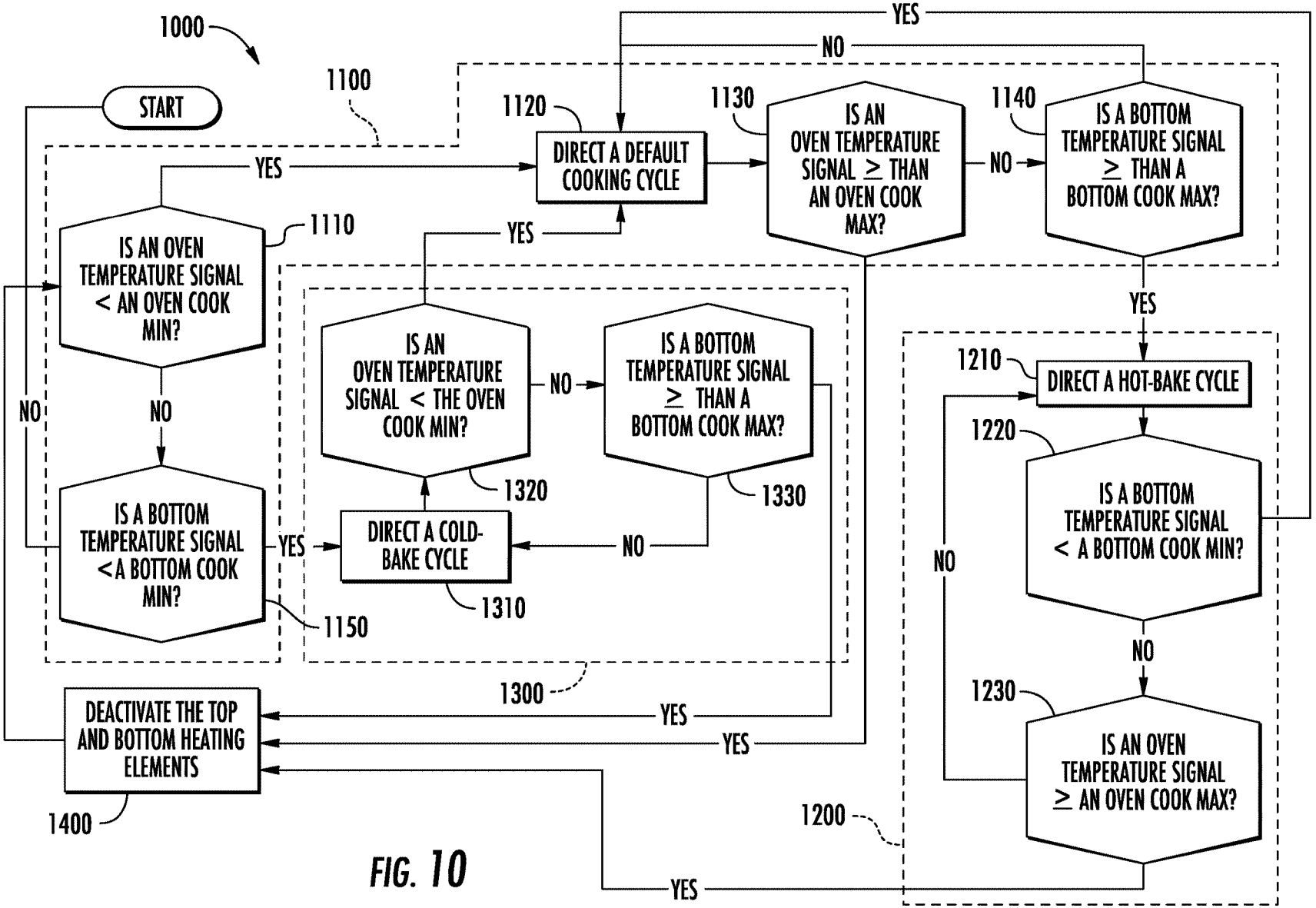
FIG. 10 is a flow chart illustrating of method of operating an oven appliance according to exemplary embodiments of the present disclosure.

Referring now to FIGS. 8 through 10, the present disclosure may further be directed to methods (e.g., method 800, 900, or 1000) of operating an oven appliance, such as appliance 100. In exemplary embodiments, the controller 110 may be operable to perform various steps of a method in accordance with the present disclosure.

The methods (e.g., 800, 900, or 1000) may occur as, or as part of, a cooking operation (e.g., short-cycle cooking operation) of oven appliance 100. In particular, the methods (e.g., 800, 900, or 1000) disclosed herein may advantageously facilitate a cooking plate or surface within a cooking chamber to be brought to a temperature (e.g., selected by a user) consistently or accurately. Additionally or alternatively, the methods (e.g., 800, 900, or 1000) may advantageously permit multiple cooking cycles to be performed in relatively quick succession (e.g., without requiring deactivation of all heating elements, without requiring significant cooling of the cooking chamber, or while facilitating rapid or even redistribution of heat within the cooking chamber between cooking cycles).

It is noted that the order of steps within methods 800, 900, and 1000 are for illustrative purposes. Moreover, none of the methods 800, 900, and 1000 are mutually exclusive. In other words, methods within the present disclosure may include one or more of methods 800, 900, and 1000. All may be adopted or characterized as being fulfilled in a common operation. Except as otherwise indicated, one or more steps in the below method 800, 900, or 1000 may be changed, rearranged, performed in a different order, or otherwise modified without deviating from the scope of the present disclosure.

Turning especially to FIG. 8, at 810, the method 800 includes receiving an oven temperature signal. For instance, the oven temperature signal may be received from the oven temperature sensor, as would be understood and generally described above. Using the oven temperature signal, a measurement or reading of temperature may be obtained. Thus, a temperature of the cooking chamber (e.g., within the cooking chamber above the bottom heating element or cooking surface) may be indicated by and determined from the oven temperature signal, as would be understood.

At 820, the method 800 includes directing activation of the top heating element and the bottom heating element. In particular, activation may be directed according to a first heating cycle based on the oven temperature signal (e.g., based on the measured temperature within the cooking chamber). Generally, the first heating cycle provides instructions for activating the top and bottom heating elements (e.g., in the form of an algorithm, instruction set, or one or more activation conditions) to heat the cooking chamber, such as to a selected or desired temperature. The first heating cycle may be, for instance, a preheating cycle of a preheating phase or a cooking cycle following a preheating phase.

In some embodiments, the first heating cycle includes a set first top heat output for the top heating element (e.g., top heat output setting in the form of a predetermined duty cycle or percentage of power output). Thus, the active, "on" time (or intensity thereof) of the top heating element during a given interval may be predetermined for the first heating cycle.

In additional or alternative embodiments, the first heating cycle includes a set first bottom heat output for the bottom heating element (e.g., bottom heat output setting in the form of a predetermined duty cycle or percentage of power output). Thus, the active, "on" time (or intensity thereof) of the bottom heating element during a given interval may be predetermined for the first heating cycle.

In further additional or alternative embodiments, the first heating cycle is a repeating activation sequence in which the top and bottom heating elements are selectively activated and deactivated (e.g., separately). For instance, such an activation sequence may include a first bottom heat (BH) active time of the bottom heating element (e.g., 45 seconds in a first preheating cycle or 33 seconds in a cooking cycle) and a first top heat (TH) active time (e.g., 15 seconds in a first preheating cycle or 9 seconds in a cooking cycle). During the first BH active time, the bottom heating element is instructed to activate (e.g., continuously). Optionally, the top heating element may be instructed to deactivate during the first BH active time. By contrast, during the first TH active time, the top heating element is instructed to activate (e.g., continuously). Optionally, the bottom heating element may be instructed to deactivate during the first TH active time. In some embodiments, the first BH active time is greater than the first TH active time. Separate from or in addition to the first BH and TH active times, a first inactive time (e.g., 8 seconds in a cooking cycle) may be included with the activation sequence to maintain both heating elements in an inactive state. As a result, exemplary embodiments may repeatedly activate the heating elements according to the repeating sequence of first BH active time (e.g., in which the bottom heating element is active) and first TH active time (e.g., in which the top heating element is active). Optionally, a first inactive time (e.g., in which the bottom heating element, the top heating element, or both, are inactive) may also be included in the repeating sequence.

Generally, the first heating cycle may continue until a set condition is met, such as expiration of a predetermined time interval, reaching a predetermined temperature, receiving a user input, or determining some intervening event has occurred.

At 830, the method 800 includes receiving a bottom temperature signal (e.g., following 810 or 820, such as during the first heating cycle). For instance, the bottom temperature signal may be received from the bottom temperature sensor, as would be understood and generally described above. Using the bottom temperature signal, a measurement or reading of temperature may be obtained. Thus, a temperature adjacent or proximate to the bottom heating element (e.g., within the cooking chamber below the cooking surface) may be indicated by and determined from the oven temperature signal, as would be understood.

In some embodiments, the method 800 includes evaluating the measured bottom temperature (i.e., the temperature indicated by the bottom temperature signal). In particular, a determination may be made that the measured bottom temperature meets or exceeds or is below one or more temperature thresholds (e.g., bottom preheat max, bottom cook max, or bottom cook min). As an example, the method 800 may include determining the bottom temperature meets or exceeds a maximum threshold (e.g., bottom preheat max or bottom cook max), which may indicate an abnormal preheating condition (e.g., in a preheating phase) or hot-bake condition (e.g., in a cooking phase), or that the bottom temperature is less than a minimum threshold, which may indicate a cold bake condition (e.g., in a cooking phase), to prompt a second preheating cycle, hot-bake cycle, or cold-bake cycle.

At 840, the method 800 includes directing activation of the bottom heating element according to a second heating cycle based on the bottom temperature signal, the second heating cycle being distinct from the first heating cycle. In some embodiments, 840 includes directing activation of the top heating element and the bottom heating element according to a second heating cycle based on the oven temperature signal (e.g., based on the measured bottom temperature adjacent or proximate to the bottom heating element). Generally, the second heating cycle provides instructions for activating the top and bottom heating elements (e.g., in the form of an algorithm, instruction set, or one or more activation conditions) to heat the cooking surface, such as to a selected or desired temperature. Advantageously, the second heating cycle may adjust heating to prevent undesirable conditions at the cooking surface, consistently heat the cooking chamber overall, or otherwise address abnormal conditions. The second heating cycle may, for instance, adjust a preheating cycle of a preheating phase or a cooking cycle following a preheating phase.

In certain embodiments, the second heating cycle includes a top heat output for the top heating element (e.g., top heat output setting in the form of a predetermined duty cycle or percentage of power output). Thus, the active, "on" time (or intensity thereof) of the top heating element during a given interval may be predetermined for the second heating cycle. Optionally, the second top heat output may be equal to the first top heat output (e.g., in the case of second preheating cycle or a hot-bake cycle). Alternatively, the second top heat output may be less than the first top heat output and even down to zero such that the top heating element is in an inactive state (e.g., in the case of a cold-bake cycle). In some such embodiments, the top heating element is held in the inactive state for the entire duration of the second heating cycle.

In additional or alternative embodiments, the second heating cycle includes a set second bottom heat output for the bottom heating element (e.g., bottom heat output setting in the form of a predetermined duty cycle or percentage of power output). Thus, the active, "on" time (or intensity thereof) of the bottom heating element during a given interval may be predetermined for the second heating cycle. Optionally, the second bottom heat output may be less than the first bottom heat output (e.g., in the case of second preheating cycle or a hot-bake cycle). Alternatively, the bottom heating element may be activated at a temperature-responsive condition based on a subsequent bottom temperature signal received from the bottom temperature sensor or a subsequent oven temperature signal received from the oven temperature sensor (e.g., such that the bottom heating element is repeatedly or continuously activated until the bottom temperature sensor measures a bottom temperature that meets or exceeds a bottom cook max or the oven temperature sensor measures an oven temperature that is below a oven min), such as in the case of a cold-bake cycle. In some such embodiments, the bottom heating element is alternately directed between an active state and an inactive state (e.g., according to a corresponding duty cycle).

In further additional or alternative embodiments, the second heating cycle is a repeating activation sequence in which the top and bottom heating elements are selectively activated and deactivated (e.g., separately). For instance, such an activation sequence may include a second bottom heat (BH) active time of the bottom heating element (e.g., 50 seconds in a cold-bake cycle), and a second top heat (TH) active time (e.g., 15 seconds in a second preheating cycle or 9 seconds in a hot-bake cycle). During the second BH active time, the bottom heating element is instructed to activate (e.g., continuously). Optionally, the top heating element may be instructed to deactivate during the second BH active time. By contrast, during the second TH active time, the top heating element is instructed to activate (e.g., continuously). Optionally, the bottom heating element may be instructed to deactivate during the second TH active time. In some embodiments, the second BH active time is greater than the first TH active time. Separate from or in addition to the second BH and TH active times, a second inactive time (e.g., 18 seconds in a second preheating cycle, 51 seconds in a hot-bake cycle, and 10 seconds in a cold-bake cycle) may be included with the activation sequence to maintain both heating elements in an inactive state. As a result, exemplary embodiments may repeatedly activate the heating elements according to the repeating sequence of second BH active time (e.g., in which the bottom heating element is active) and second TH active time (e.g., in which the top heating element is active). Optionally, a second inactive time (e.g., in which the bottom heating element, the top heating element, or both, are inactive) may also be included in the repeating sequence.

Generally, the second heating cycle may continue until a set condition is met, such as expiration of a predetermined time interval, reaching a predetermined temperature, receiving a user input, or determining some intervening event has occurred.

In certain embodiments, the second heating cycle is set to continue until one or more temperatures is reached at the oven temperature sensor. Thus, the method 800 may include receiving a second temperature signal (e.g., oven or bottom temperature signal) subsequent to 840 and directing activation of the top or bottom heating cycle (e.g., according to the first or second heating cycle) based on the second temperature signal.

In exemplary embodiments of a second preheating cycle, the second preheating cycle may continue or repeat until the oven temperature meets or exceeds the oven preheat max. In other words, another (e.g., second) oven temperature signal received subsequent to the first oven temperature signal may indicate the oven preheat max is met or exceeded, and the second preheating cycle may be halted in response to the same. Subsequently, the preheating phase may end such that a cooking phase may be initiated. In additional or alternative embodiments of a second preheating cycle, the second preheating cycle may continue or repeat until the bottom temperature is determined to be less than a bottom preheat min (e.g., minimum threshold). In other words, another (e.g., second) bottom temperature signal received subsequent to the first bottom temperature signal may indicate the bottom preheat min is no longer met or exceeded, and the second preheating cycle may be halted in response to the same. In response to such an indication, the method 800 may return to the first preheating cycle.

In exemplary embodiments of a hot-bake cycle, the hot-bake cycle may continue or repeat until the oven temperature meets or exceeds the oven cook max (e.g., maximum threshold). In other words, another (e.g., second) temperature signal received subsequent to the first oven temperature signal may indicate the oven cook max is met or exceeded, and the hot-bake cycle may be halted in response to the same. In additional or alternative embodiments of a hot-bake cycle, the hot-bake cycle may continue or repeat until the bottom temperature is determined to be less than a bottom cook min (e.g., minimum threshold). In other words, another (e.g., second) temperature signal received subsequent to the first bottom temperature signal may indicate the bottom cook min is no longer met or exceeded, and the hot-bake cycle may be halted in response to the same. Subsequent or in response to the hot-bake cycle ending, the method 800 may return to the cooking cycle.

In exemplary embodiments of a cold-bake cycle, the cold-bake cycle may continue or repeat until the oven temperature is below the oven min (e.g., minimum threshold). In other words, another (e.g., second) temperature signal received subsequent to the first oven temperature signal may indicate the oven min is no longer met or exceeded, and the cold-bake cycle may be halted in response to the same. Subsequent or in response to such an indication, the method 800 may return to the cooking cycle. In additional or alternative embodiments of a cold-bake cycle, the cold-bake cycle may continue or repeat until the bottom temperature is determined to meet or exceed a bottom cook max (e.g., maximum threshold). In other words, another (e.g., second) temperature signal received subsequent to the first bottom temperature signal may indicate the bottom cook max is met or exceeded, and the cold-bake cycle may be halted in response to the same. Subsequent or in response to the cold-bake cycle ending, the method 800 may return to the cooking cycle (e.g., after directing the top and bottom heating elements to an inactive state for a set period of time or determining the oven temperature is again below the oven min).

Turning now to FIG. 9, at 910, the method 900 includes evaluating the oven temperature. Specifically, an oven temperature signal (e.g., first oven temperature signal) may be received from the oven temperature sensor, as would be understood and generally described above. Using the oven temperature signal, a measurement or reading of temperature at the oven temperature sensor may be obtained. Once obtained, the oven temperature may be compared to a predetermined oven preheat max. If the oven temperature is determined to meet or exceed the oven preheat max, the method 900 may proceed directly to 980. By contrast, if the oven temperature is determined to not meet or exceed the oven preheat max, the method 900 may proceed to 920 (e.g., and may thus be based on the oven temperature signal).

At 920, the method 900 includes directing a first preheating cycle. Specifically, activation of the top and bottom heating elements may be directed according to the first preheating cycle. Generally, the first preheating cycle provides instructions for activating the top and bottom heating elements (e.g., in the form of an algorithm, instruction set, or one or more activation conditions) to heat the cooking chamber, such as to a selected or desired preheat temperature. For instance, a set first top heat output and set first bottom heat output may be provided. Additionally or alternatively, the first preheating cycle may include a repeating activation sequence in which the top and bottom heating elements are selectively activated and deactivated (e.g., separately). For instance, such an activation sequence may include a first bottom heat (BH) active time of the bottom heating element and a first top heat (TH) active time. During the first BH active time, the bottom heating element is instructed to activate (e.g., continuously). Optionally, the top heating element may be instructed to deactivate during the first BH active time. By contrast, during the first TH active time, the top heating element is instructed to activate (e.g., continuously). Optionally, the bottom heating element may be instructed to deactivate during the first TH active time. In some embodiments, the first BH active time is greater than the first TH active time. As a result, exemplary embodiments may repeatedly activate the heating elements according to the repeating sequence of first BH active time (e.g., in which the bottom heating element is active) and first TH active time (e.g., in which the top heating element is active). Optionally, a first inactive time (e.g., in which the bottom heating element, the top heating element, or both, are inactive) may also be included in the repeating sequence.

After starting the first preheating oven cycle at 920, the method 900 may proceed to 930 (e.g., while continuing to direct the heating elements according to the first preheating cycle).

At 930, the method 900 includes reevaluating the oven temperature. Specifically, a new (e.g., second) oven temperature signal may be received from the oven temperature sensor, as would be understood and generally described above. Using the new or second oven temperature signal, a measurement or reading of temperature at the oven temperature sensor may be obtained. Once obtained, the new or second oven temperature may be compared to the predetermined oven preheat max. If the second oven temperature is determined to meet or exceed the oven preheat max, the method 900 may proceed directly to 980. By contrast, if the new or second oven temperature is determined to not meet or exceed the oven preheat max, the method 900 may proceed to 940.

At 940, the method 900 includes evaluating a bottom temperature. Specifically, a bottom temperature signal (e.g., first bottom temperature signal) may be received from the bottom temperature sensor, as would be understood and generally described above. Using the bottom temperature signal, a measurement or reading of temperature at the bottom temperature sensor may be obtained. Once obtained, the bottom temperature may be compared to a predetermined bottom preheat max. If the bottom temperature is determined to meet or exceed the bottom preheat max, the method 900 may proceed to 950 (e.g., and may thus be based on the bottom temperature signal). By contrast, if the bottom preheat max is determined to not meet or exceed the oven preheat max, the method 900 may return to 920 (e.g., continue the first preheating cycle, which is thus also based on the bottom temperature signal).

At 950, the method 900 includes directing a second preheating cycle, which is separate and distinct from the first preheating cycle. Thus, the first preheating cycle is halted in order to proceed with the second preheating cycle. In turn, activation of the top and bottom heating elements may be directed according to the second preheating cycle. Generally, the second preheating cycle provides instructions for activating the top and bottom heating elements (e.g., in the form of an algorithm, instruction set, or one or more activation conditions) to heat the cooking surface, such as to a selected or desired preheat temperature. For instance, a set second top heat output and set second bottom heat output may be provided. Additionally or alternatively, the second preheating cycle may include a repeating activation sequence in which the top heating element or bottom heating elements is/are selectively activated and deactivated (e.g., separately). For instance, such an activation sequence may include a second bottom heat (BH) active time of the bottom heating element (e.g., that is less than the first BH active time) or a second top heat (TH) active time (e.g., that is equal to the first TH active time). During the second BH active time, the bottom heating element is instructed to activate (e.g., continuously or while the top heating element is inactive). Optionally, the bottom heating element may held in an inactive state during the entire second preheating cycle. By contrast, during the second TH active time, the top heating element is instructed to activate (e.g., continuously or while the top heating element is inactive). In some embodiments, the second TH active time is greater than the second BH active time. In additional or alternative embodiments, an inactive time (e.g., second inactive time) is included with the activation sequence to maintain both heating elements in an inactive state. As a result, exemplary embodiments may repeatedly activate the heating elements according to the repeating sequence, such as a second TH active time (e.g., in which the top heating element is active) and a second inactive time (e.g., in which both the top and bottom heating elements are held in an inactive state). Optionally, a second BH active time (e.g., in which the bottom heating element is active) may also be included in the repeating sequence.

At 960, the method 900 includes reevaluating the bottom temperature in light of a bottom preheat min. Specifically, a new (e.g., second) bottom temperature signal may be received from the bottom temperature sensor, as would be understood and generally described above. Using the new or second bottom temperature signal, a measurement or reading of temperature at the bottom temperature sensor may be obtained. Once obtained, the new or second bottom temperature may be compared to a predetermined bottom preheat min (e.g., set as a value that is less the bottom preheat max by a predetermined, fixed range value). If the bottom temperature is determined to be less than (i.e., below) the bottom preheat min, the method 900 may return to 920 (e.g., reinstate the first preheating cycle). By contrast, if the second bottom temperature is determined to meet or exceed the bottom preheat min, the method 900 may proceed to 970.

At 970, the method 900 includes reevaluating the oven temperature. Specifically, a new (e.g., third) oven temperature signal may be received from the oven temperature sensor, as would be understood and generally described above. Using the new or third oven temperature signal, a measurement or reading of temperature at the oven temperature sensor may be obtained. Once obtained, the new or third oven temperature may be compared to the oven preheat max. If the oven temperature is determined to be greater than (i.e., above) or equal to the oven preheat max, the method 900 may proceed directly to 980. By contrast, if the third oven temperature is determined not to meet or exceed the oven preheat max, the method 900 may return to 950 (e.g., continue the second preheating cycle, which is thus also based on the oven temperature signal).

At 980, the method 900 includes directing preparation for a cooking cycle. This may include, for example, directing the top or bottom heating element(s) to an inactive state while waiting for the cooking cycle to be initiated (e.g., in response to expiration of a set time interval or reception of a user input).

Turning now to FIG. 10, the method 1000 generally provides for three discrete cooking conditions, including a default cooking condition 1100, hot-bake condition 1200, and cold-bake condition 1300.

As shown, the method 1000 generally starts in the default cooking condition 1100 (e.g., following a preheating cycle or preheat phase).

At 1110, the method 1000 includes evaluating the oven temperature. Specifically, an oven temperature signal (e.g., first oven temperature signal) may be received from the oven temperature sensor, as would be understood and generally described above. Using the oven temperature signal, a measurement or reading of temperature at the oven temperature sensor may be obtained. Once obtained, the oven temperature may be compared to a predetermined oven cook min (e.g., minimum threshold, which may be set as a value that is less than an oven cook max by a predetermined, fixed range value). If the oven temperature is determined to meet or exceed the oven cook min, the method 1000 may proceed directly to 1150. By contrast, if the oven temperature is determined to not meet or exceed the oven cook min, the method 1000 may proceed to 1120 (e.g., and may thus be based on the oven temperature signal).

At 1120, the method 1000 includes directing a default (e.g., first) cooking cycle. Specifically, activation of the top and bottom heating elements may be directed according to the default cooking cycle. Generally, the default cooking cycle provides instructions for activating the top and bottom heating elements (e.g., in the form of an algorithm, instruction set, or one or more activation conditions) to heat the cooking chamber, such as to a selected or desired cook temperature. For instance, a set default top heat output and set default bottom heat output may be provided. Additionally or alternatively, the default cooking cycle may include a repeating activation sequence in which the top and bottom heating elements are selectively activated and deactivated (e.g., separately). For instance, such an activation sequence may include a default bottom heat (DBH) active time of the bottom heating element and a default top heat (DTH) active time. During the DBH active time, the bottom heating element is instructed to activate (e.g., continuously). Optionally, the top heating element may be instructed to deactivate during the DBH active time. By contrast, during the DTH active time, the top heating element is instructed to activate (e.g., continuously). Optionally, the bottom heating element may be instructed to deactivate during the DTH active time. In some embodiments, the DBH active time is greater than the DTH active time. As a result, exemplary embodiments may repeatedly activate the heating elements according to the repeating sequence of DBH active time (e.g., in which the bottom heating element is active) and DTH active time (e.g., in which the top heating element is active). Optionally, a default inactive time (e.g., in which the bottom heating element, the top heating element, or both, are inactive) may also be included in the repeating sequence.

After starting the first or default cooking oven cycle at 1120, the method 1000 may proceed to 1130 (e.g., while continuing to direct the heating elements according to the default cooking cycle).

At 1130, the method 1000 includes reevaluating the oven temperature. Specifically, a new (e.g., second) oven temperature signal may be received from the oven temperature sensor, as would be understood and generally described above. Using the new or second oven temperature signal, a measurement or reading of temperature at the oven temperature sensor may be obtained. Once obtained, the new or second oven temperature may be compared to a predetermined oven cook max (e.g., maximum threshold). If the second oven temperature is determined to meet or exceed the oven cook max, the method 1000 may proceed directly to 1400. By contrast, if the new or second oven temperature is determined to not meet or exceed the oven cook max, the method 1000 may proceed to 1140.

At 1140, the method 1000 includes evaluating a bottom temperature. Specifically, a bottom temperature signal (e.g., first bottom temperature signal) may be received from the bottom temperature sensor, as would be understood and generally described above. Using the bottom temperature signal, a measurement or reading of temperature at the bottom temperature sensor may be obtained. Once obtained, the bottom temperature may be compared to a predetermined bottom cook max(e.g., maximum threshold). If the bottom temperature is determined to meet or exceed the bottom cook max, the method 1000 may proceed to the hot-bake condition 1200 (e.g., at 1210). By contrast, if the bottom temperature is determined to not meet or exceed the bottom cook max, the method 1000 may return to 1120 (e.g., continue the default cooking cycle, which is thus also based on the bottom temperature signal).

At 1210, the method 1000 includes directing a hot-bake cycle, which is separate and distinct from the default cooking cycle. Thus, the default cooking cycle is halted in order to proceed with the hot-bake cycle. In turn, activation of the top and bottom heating elements may be directed according to the hot-bake cycle. Generally, the hot-bake cycle provides instructions for activating the top and bottom heating elements (e.g., in the form of an algorithm, instruction set, or one or more activation conditions) to heat the cooking surface, such as to a selected or desired cook temperature. For instance, a set hot-bake (e.g., second) top heat output and set hot-bake (e.g., second) bottom heat output may be provided. Additionally or alternatively, the hot-bake cycle may include a repeating activation sequence in which the top heating element or bottom heating elements is/are selectively activated and deactivated (e.g., separately). For instance, such an activation sequence may include a HB bottom heat (HBBH) active time of the bottom heating element (e.g., that is less than the DBH active time) or a HB top heat (HBTH) active time (e.g., that is equal to the DTH active time). During the HBBH active time, the bottom heating element is instructed to activate (e.g., continuously or while the top heating element is inactive). Optionally, the bottom heating element may held in an inactive state during the entire hot-bake cycle. By contrast, during the HBTH active time, the top heating element is instructed to activate (e.g., continuously or while the bottom heating element is inactive). In some embodiments, the HBTH active time is greater than the HBBH active time. In additional or alternative embodiments, an inactive time (e.g., HB inactive time) is included with the activation sequence to maintain both heating elements in an inactive state. As a result, exemplary embodiments may repeatedly activate the heating elements according to the repeating sequence, such as a HBTH active time (e.g., in which the top heating element is active) and a HBBH time (e.g., in which the bottom heating element is active). Optionally, a HB inactive time (e.g., in which the bottom heating element, the top heating element, or both, are inactive) may also be included in the repeating sequence.

At 1220, the method 1000 includes reevaluating the bottom temperature in light of a predetermined bottom cook min (e.g., minimum threshold). Specifically, a new (e.g., second) bottom temperature signal may be received from the bottom temperature sensor, as would be understood and generally described above. Using the new or second bottom temperature signal, a measurement or reading of temperature at the bottom temperature sensor may be obtained. Once obtained, the new or second bottom temperature may be compared to the predetermined bottom cook min (e.g., a bottom cooking value, which may be set as a value that is less than the bottom cook max by a predetermined, fixed range value). If the bottom temperature is determined to be less than (i.e., below) the bottom cook min, the method 1000 may return to the default cooking condition 1100 at 1120 (e.g., reinstate the default cooking cycle). By contrast, if the second bottom temperature is determined to meet or exceed the bottom cook min, the method 1000 may proceed to 1230.

At 1230, the method 1000 includes reevaluating the oven temperature. Specifically, a new (e.g., third) oven temperature signal may be received from the oven temperature sensor, as would be understood and generally described above. Using the new or third oven temperature signal, a measurement or reading of temperature at the oven temperature sensor may be obtained. Once obtained, the new or third oven temperature may be compared to the oven cook max. If the oven temperature is determined to meet or exceed (i.e., be greater than or above) the oven cook max, the method 1000 may proceed directly to 1400. By contrast, if the third oven temperature is determined not to meet or exceed the oven cook max, the method 1000 may return to 1210 (e.g., continue the hot-bake cycle, which is thus also based on the oven temperature signal).

As noted above, if the oven temperature is determined to meet or exceed the oven cook min at 1110, method 1000 may proceed to 1150. At 1150, the method 1000 includes evaluating or reevaluating the bottom temperature in light of the bottom cook min (e.g., minimum threshold). Specifically, a new (e.g., third) bottom temperature signal may be received from the bottom temperature sensor, as would be understood and generally described above. Using the new or third bottom temperature signal, a measurement or reading of temperature at the bottom temperature sensor may be obtained. Once obtained, the new or third bottom temperature may be compared to the predetermined bottom cook min. If the bottom temperature is determined to greater than or equal to the bottom cook min, the method 1000 may return to 1110 (e.g., again evaluate the oven temperature). By contrast, if the third bottom temperature is determined to be less than bottom cook min, the method 1000 may proceed to the cold-bake condition 1300 at 1310.

At 1310, the method 1000 includes directing a cold-bake cycle, which is separate and distinct from the default cooking cycle and hot-bake cycle. Thus, the default cooking cycle is halted in order to proceed with the cold-bake cycle. In turn, activation of the top and bottom heating elements may be directed according to the cold-bake cycle. Generally, the cold-bake cycle provides instructions for activating the top and bottom heating elements (e.g., in the form of an algorithm, instruction set, or one or more activation conditions) to heat the cooking surface, such as to a selected or desired cook temperature. For instance, a set cold-bake (e.g., third) top heat output and set cold-bake (e.g., third) bottom heat output may be provided. Additionally or alternatively, the cold-bake cycle may include a repeating activation sequence in which the top heating element or bottom heating elements is/are selectively activated and deactivated (e.g., separately). For instance, such an activation sequence may include a CB bottom heat (CBBH) active time of the bottom heating element (e.g., that is greater than the DBH active time) or a CB top heat (CBTH) active time (e.g., that is less than the DTH active time). During the CBBH active time, the bottom heating element is instructed to activate (e.g., continuously or while the top heating element is inactive). By contrast, during the CBTH active time, the top heating element is instructed to activate (e.g., continuously or while the top heating element is inactive). In some embodiments, the CBTH active time is less than the CBBH active time. Additionally or alternatively, the top heating element may held in an inactive state during the entire cold-bake cycle. In further additional or alternative embodiments, an inactive time (e.g., CB inactive time) is included with the activation sequence to maintain both heating elements in an inactive state. As a result, exemplary embodiments may repeatedly activate the heating elements according to the repeating sequence, such as a CBBH active time (e.g., in which the bottom heating element is active) and a CB inactive time (e.g., in which both the top and bottom heating elements are held in an inactive state). Optionally, a CBTH active time (e.g., in which the top heating element is active) may also be included in the repeating sequence.

At 1320, the method 1000 includes reevaluating the oven temperature. Specifically, a new (e.g., fourth) oven temperature signal may be received from the oven temperature sensor, as would be understood and generally described above. Using the new or fourth oven temperature signal, a measurement or reading of temperature at the oven temperature sensor may be obtained. Once obtained, the new or fourth oven temperature may be compared to the oven cook min. If the oven temperature is determined to be less than the oven cook min, the method 1000 may return to the default cooking condition 1100 at 1120 (e.g., reinstate the default cooking cycle). By contrast, if the fourth oven temperature is determined to be greater than or equal to the oven cook min, the method 1000 may proceed to 1330.

At 1330, the method 1000 includes evaluating the bottom temperature. Specifically, a new (e.g., fourth) bottom temperature signal may be received from the bottom temperature sensor, as would be understood and generally described above. Using the bottom temperature signal, a measurement or reading of temperature at the bottom temperature sensor may be obtained. Once obtained, the new or fourth bottom temperature may be compared to the predetermined bottom cook max (e.g., maximum threshold). If the new or fourth bottom temperature is determined to meet or exceed the bottom cook max, the method 1000 may proceed directly to 1400. By contrast, if the new or fourth bottom temperature is determined to not meet or exceed the bottom cook max, the method 1000 may return to 1320 (e.g., again reevaluate the oven temperature).

At 1400, the method 1000 include directing preparation for a new cooking cycle. This may include, for example, directing the top or bottom heating element(s) to an inactive state while waiting for the cooking cycle to be initiated (e.g., in response to expiration of a set time interval or reception of a user input), such as to return to the default cooking condition 1100 at 1110.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance comprising:

a cabinet;

a plurality of chamber walls mounted within the cabinet, the plurality of chamber walls defining a cooking chamber, the plurality of chamber walls comprising a back wall, a top wall, a first side wall, a second side wall, and a bottom wall;

a cooking surface defined in the cooking chamber between the bottom wall and the top wall of the plurality of chamber walls;

a top heating element mounted above the cooking surface to heat the cooking chamber;

an oven temperature sensor disposed within the cabinet;

a bottom heating element mounted below the cooking surface to heat the cooking surface;

a bottom temperature sensor disposed below the oven temperature sensor; and a controller in operative communication with the top heating element, the oven temperature sensor, the bottom heating element, and the bottom temperature sensor, the controller being configured to initiate a cooking operation comprising receiving an oven temperature signal from the oven temperature sensor to indicate an oven temperature, directing activation of the bottom heating element according to a first heating cycle based on the oven temperature signal, receiving, following the first heating cycle, a bottom temperature signal from the bottom temperature sensor to indicate a bottom temperature, evaluating the bottom temperature against one or more predetermined temperature thresholds, selecting a second heating cycle from a plurality of discrete predetermined cycles based on evaluating the bottom temperature, the plurality of discrete predetermined cycles comprising a first cycle option having a first operating characteristic and a second cycle option having a second operating characteristic, the second operating characteristic being distinct from the first operating characteristic, and directing activation of the bottom heating element according to the selected second heating cycle, the second heating cycle being distinct from the first heating cycle.

2. The oven appliance of claim 1, wherein the cooking operation further comprises determining the bottom temperature meets or exceeds a maximum threshold, wherein directing activation of the bottom heating element according to the second heating cycle is in response to determining the bottom temperature meets or exceeds the maximum threshold, wherein the first heating cycle comprises a first bottom heat output of the bottom heating element, and wherein the second heating cycle comprises a second bottom heat output of the bottom heating element, the second bottom heat output being less than the first bottom heat output.

3. The oven appliance of claim 2, wherein the first heating cycle comprises a set first top heat output of the top heating element, and wherein the second heating cycle comprises a set second top heat output of the top heating element, the set second top heat output being equal to the set first top heat output.

4. The oven appliance of claim 2, wherein the first heating cycle is a repeating activation sequence comprising a first bottom heat (BH) active time of the bottom heating element and a first top heat (TH) active time of the top heating element, and wherein the second heating cycle is a repeating activation sequence comprising a second BH active time of the bottom heating element, a second TH active time of the top heating element, the second BH active time being less than the first BH active time.

5. The oven appliance of claim 1, wherein the cooking operation further comprises determining the bottom temperature is below a minimum threshold, and wherein the second heating cycle comprises activating the bottom heating element at a temperature-responsive condition based on a subsequent bottom temperature signal received from the bottom temperature sensor.

6. The oven appliance of claim 5, wherein the second heating cycle comprises alternately directing the bottom heating element between an active state and an inactive state.

7. The oven appliance of claim 5, wherein the second heating cycle comprises holding the top heating element in an inactive state for an entire duration of the second heating cycle, and directing the bottom heating element to an active state while the top heating element is in the inactive state.

8. The oven appliance of claim 1, wherein the oven temperature signal is a first oven temperature signal, and wherein the cooking operation further comprises receiving a second oven temperature signal from the oven temperature sensor subsequent to directing activation of the bottom heating element according to the second heating cycle, and directing activation of the top heating element and the bottom heating element according to the first heating cycle based on the second oven temperature signal.

9. The oven appliance of claim 1, wherein the bottom temperature signal is a first bottom temperature signal, and wherein the cooking operation further comprises receiving a second bottom temperature signal from the bottom temperature sensor, and directing activation of the bottom heating element according to the second heating cycle based on the second bottom temperature signal.

10. A method of operating an oven appliance comprising a plurality of chamber walls mounted within a cabinet and defining a cooking chamber, a cooking surface defined in the cooking chamber between a bottom wall and a top wall of the plurality of chamber walls, a top heating element mounted above the cooking surface to heat the cooking chamber, and a bottom heating element mounted below the cooking surface to heat the cooking surface, the method comprising:

receiving an oven temperature signal to indicate an oven temperature;

directing activation of the bottom heating element according to a first heating cycle based on the oven temperature signal;

receiving a bottom temperature signal to indicate a bottom temperature;

evaluating the bottom temperature against one or more predetermined temperature thresholds;

selecting a second heating cycle from a plurality of discrete predetermined cycles based on evaluating the bottom temperature, the plurality of discrete predetermined cycles comprising a first cycle option having a first operating characteristic and a second cycle option having a second operating characteristic, the second operating characteristic being distinct from the first operating characteristic; and directing activation of the bottom heating element according to the selected second heating cycle, the second heating cycle being distinct from the first heating cycle.

11. The method of claim 10, further comprising:

determining the bottom temperature exceeds a maximum threshold, wherein directing activation of the bottom heating element according to the second is in response to determining the bottom temperature meets or exceeds the maximum threshold, wherein the first heating cycle comprises a first bottom heat output of the bottom heating element, and wherein the second heating cycle comprises a second bottom heat output of the bottom heating element, the second bottom heat output being less than the first bottom heat output.

12. The method of claim 11, wherein the first heating cycle comprises a set first top heat output of the top heating element, and wherein the second heating cycle comprises a set second top heat output of the top heating element, the set second top heat output being equal to the set first top heat output.

13. The method of claim 11, wherein the first heating cycle is a repeating activation sequence comprising a first bottom heat (BH) active time of the bottom heating element and a first top heat (TH) active time of the top heating element, and wherein the second heating cycle is a repeating activation sequence comprising a second BH active time of the bottom heating element, a second TH active time of the top heating element, the second BH active time being less than the first BH active time.

14. The method of claim 10, further comprising:

determining the bottom temperature is below a minimum threshold, wherein the second heating cycle comprises activating the bottom heating element at a temperature-responsive condition based on a subsequent bottom temperature signal.

15. The method of claim 14, wherein the second heating cycle comprises alternately directing the bottom heating element between an active state and an inactive state.

16. The method of claim 14, wherein the second heating cycle comprises holding the top heating element in an inactive state for an entire duration of the second heating cycle, and directing the bottom heating element to an active state while the top heating element is in the inactive state.

17. The method of claim 10, wherein the oven temperature signal is a first oven temperature signal, and wherein the method further comprises:

receiving a second oven temperature signal subsequent to directing activation of the bottom heating element according to the second heating cycle; and directing activation of the top heating element and the bottom heating element according to the first heating cycle based on the second oven temperature signal.

18. The method of claim 10, wherein the bottom temperature signal is a first bottom temperature signal, and wherein the method further comprises:

receiving a second bottom temperature signal, and directing activation of the bottom heating element according to the second heating cycle based on the second bottom temperature signal.

19. An oven appliance comprising:

a cabinet;

a plurality of chamber walls mounted within the cabinet, the plurality of chamber walls defining a cooking chamber, the plurality of chamber walls comprising a back wall, a top wall, a first side wall, a second side wall, and a bottom wall;

a cooking surface defined in the cooking chamber between the bottom wall and the top wall of the plurality of chamber walls;

a top heating element mounted above the cooking surface to heat the cooking chamber;

an oven temperature sensor disposed within the cabinet;

a bottom heating element mounted below the cooking surface to heat the cooking surface;

a bottom temperature sensor disposed below the oven temperature sensor; and a controller in operative communication with the top heating element, the oven temperature sensor, the bottom heating element, and the bottom temperature sensor, the controller being configured to initiate a cooking operation comprising receiving an oven temperature signal from the oven temperature sensor to indicate an oven temperature, directing activation of the bottom heating element and the top heating element according to a first heating cycle based on the oven temperature signal, the first heating cycle comprising a first top heat output setting for the top heating element, receiving, following the first heating cycle, a bottom temperature signal from the bottom temperature sensor to indicate a bottom temperature, evaluating the bottom temperature against one or more predetermined temperature thresholds, selecting a second heating cycle from a plurality of discrete predetermined cycles based on evaluating the bottom temperature, the plurality of discrete predetermined cycles comprising a hot-bake cycle and a cold-bake cycle, the hot-bake cycle having a HB top heat output setting for the top heating element that is equal to the first top heat output setting, the cold-bake cycle having a CB top heat output setting for the top heating element that is less than the first top heat output setting, and directing the selected second heating cycle, the second heating cycle being distinct from the first heating cycle.

* * * * *